United States Patent [19]

Paxton

[11] Patent Number: 4,913,445

[45] Date of Patent: Apr. 3, 1990

[54] METHOD OF AND APPARATUS FOR ORIENTATING BOWLING PINS

[76] Inventor: James H. Paxton, 9324 River Rd., Spring Hill, Fla. 34608

[21] Appl. No.: 349,764

[22] Filed: May 10, 1989

[51] Int. Cl.[4] ..... A63D 5/09

[52] U.S. Cl. ..... 273/43 D; 273/43 E

[58] Field of Search ..... 273/43 R, 43 A, 43 D, 273/43 E

[56] References Cited

U.S. PATENT DOCUMENTS 3,966,206 6/1976 Schmid ..... 273/43 E 4,340,221 7/1982 Camilleri ..... 273/43 E 4,410,177 10/1983 Richardson ..... 273/43 D

*Primary Examiner*—Anton O. Oechsle

*Attorney, Agent, or Firm*—Herbert W. Larson

[57] ABSTRACT

Mounting a right and left angled orientating rod on a pin wheel guard on each side of an opening from a pin wheel, securing a first end of the orientating rods with an adjustable screw to permit adjustment in alignment of each orientating rod so that a second end of the rod partially covers a top end of a bowling pin descending from a pin wheel to a distributor belt to orient the bowling pin and cause it to descend base first down a moving distributor to a pin spotting apparatus.

10 Claims, 2 Drawing Sheets

METHOD OF AND APPARATUS FOR ORIENTATING BOWLING PINS

BACKGROUND OF THE INVENTION

1. Field of The Invention

This invention relates to methods of orientating bowling pins in automatic pin setters. More particularly, it refers to a method of orientating bowling pins coming off a pin wheel for lifting pins from a well to a distributor belt.

2. Description of the Prior Art

In the bowling business, pin machine jams constitute the majority of down time for automatic pin setters. In automatic pin conveying machines such as shown in U.S. Pat. Nos. 3,004,760 and 3,117,784, incorporated herein by reference, pins may jam at the chute or distributor belt prior to delivery to the pin spotting apparatus. This is caused by pins not being placed on the distributor belt with its base pointing downwardly after coming off the pin wheel. Attempts have been made to properly align pins in an upward delivery mode as shown in U.S. Pat. Nos. 3,966,206 and 4,340,221. In the former patent, pins are turned and delivered to the distributor belt bottom first. However, the delivery system is an elevator type apparatus and not a pin wheel as used in AMF type automatic pinsetters. The sensing and holding levers of U.S. Pat. No. 3,966,206, require delivery of the pin up and under the levers 3A and 3B, whereas in AMF and Brunswick Pin setting machines, the pins are delivered from the side of the lifting apparatus.

In U.S. Pat. No. 4,340,221, a guide bar 16 pushes a head first delivered pin forward, causing delivery to the distributor belt in an unacceptable position. This guide bar 16 only guides a pin into the turnaround pan and the turnaround pan still has to orient the pin in the proper base down alignment before its delivery to the distributor belt. Although guide bar 16 helps to prevent turnaround pan pin jams, it does not prevent pile ups, misfeed or pins rolling off the turnaround pan. A method (and apparatus for protecting the method) is needed to prevent such pile ups, misfeeds and pin movement prior to the movement of pins into the pin spotting apparatus.

SUMMARY OF THE INVENTION

I have discovered a method for and structure for almost completely eliminating pin jams, misfeeds, pile ups and falling pins caused by poor pin orientation at the turnaround pan of AMF type automatic pin setting machines, such as the AMF Model 8270.

My method is the mounting of a pair of offset right angled orientating rods on a top surface of a pin wheel guard on each side of the opening from the pin wheel to the turnaround pan.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
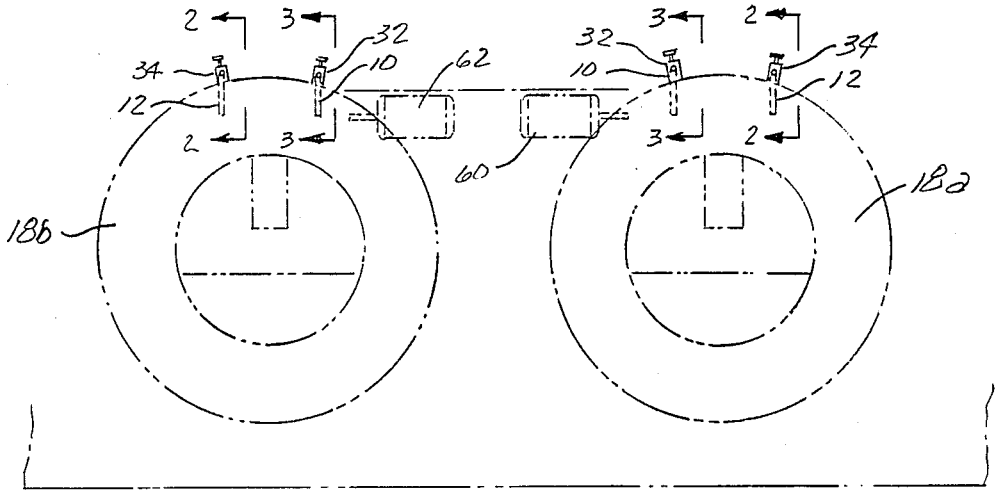
FIG. 1 is a phantom rear view of a pair of pin wheels in separate pin setting machines with motors driving the respective pin wheels.
Figure 2:
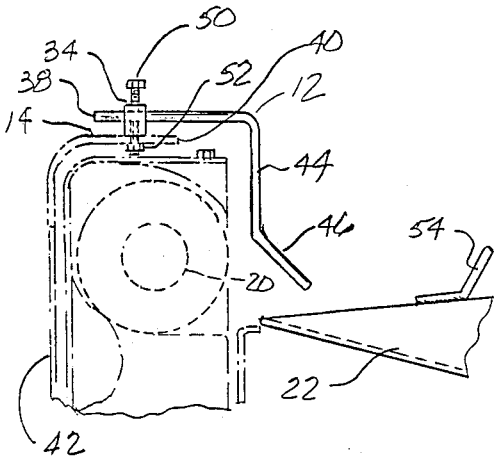
FIG. 2 is a cross section through 2—2 in FIG. 1.
Figure 3:
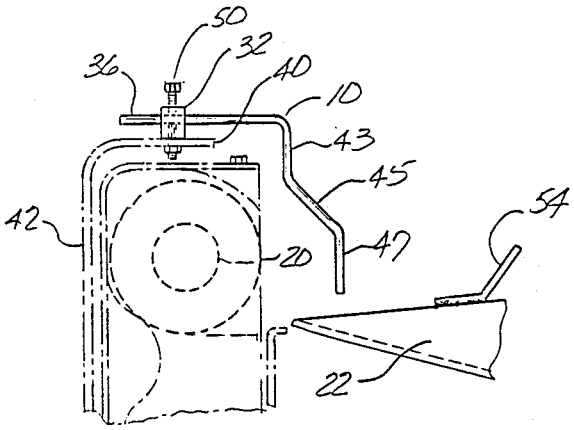
FIG. 3 is a cross section through 3—3 in FIG. 1.

Throughout the following detailed description, the same reference numerals refer to the same elements in all figures.

Figure 4:
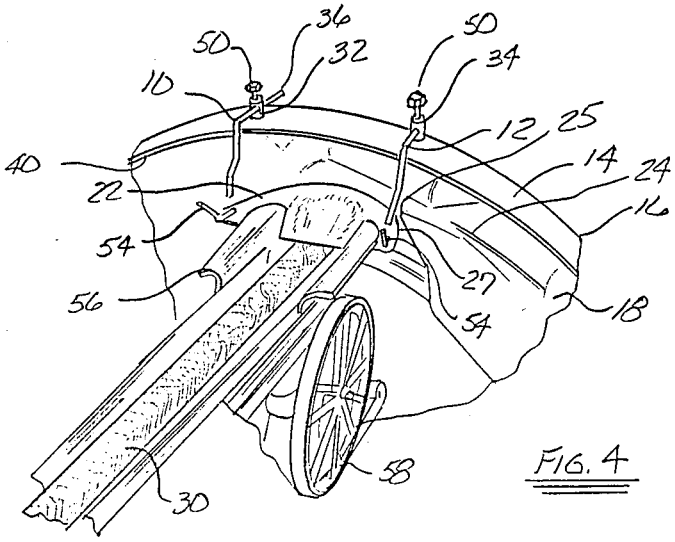
FIG. 4 is a perspective view of a portion of a pin setting machine showing the exit from a pin wheel to a turnaround pan.

Referring first to FIG. 4, a left orientating rod 10 and a right orientating rod 12 are mounted on the top surface 14 of a pin wheel guard 16. The pin wheel 18 moves within guard 16 and acts to lift bowling pins 20 from a well, not shown, to a top mounted turnaround pan 22. The pin pan 24 of the pin wheel 18 stops at edge 25 as seen in FIG. 4 and allows pin 20 to fall out of the pin wheel 18 onto the turnaround pan 22.

Figure 6:
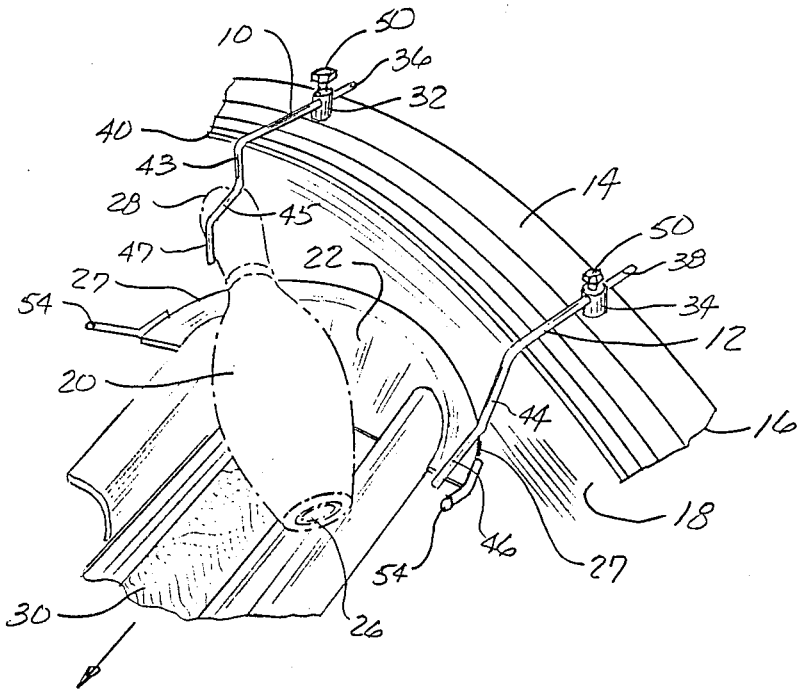
FIG. 6 is a perspective view of a bowling pin oriented by a left side orientating rod.

As the pin 20 descends from the pin wheel on to turnaround pan 22, the left orientating rod 10 will contact the top portion 28 of the pin 20 if it is presented in its direction and this turns the pin 20 as seen in FIG. 6 so that its base 26 faces out from the pin wheel on the distributor belt 30. The pin 20 then proceeds on the distributor belt to the pin setting apparatus, not shown.

Figure 5:
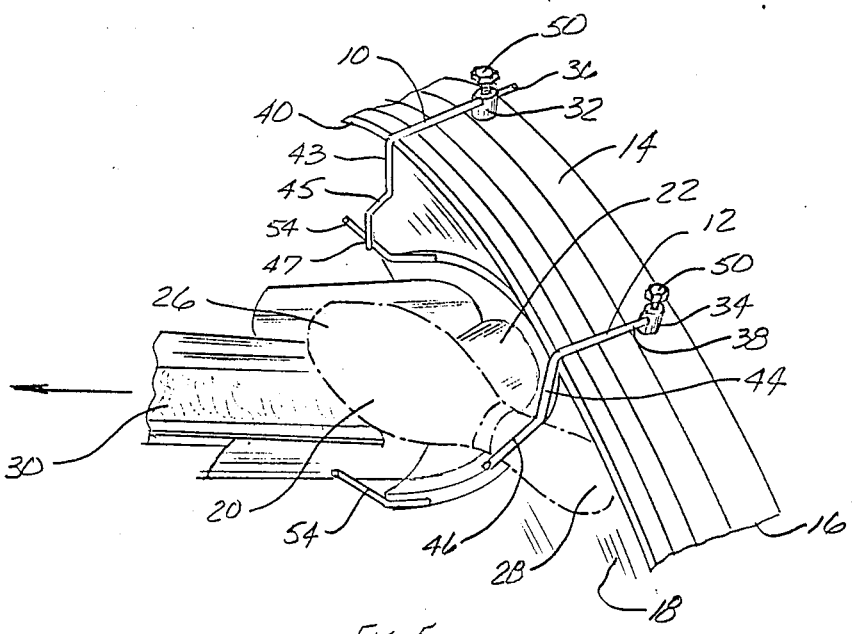
FIG. 5 is a perspective view of a bowling pin oriented by a right side orientating rod.

If the pin 20 is presented with its head 28 towards the right side of the pin wheel 18 then right side orientating rod 12 will contact the head and orient it so that base 26 properly faces on the distributor belt 30. See FIG. 5.

A mounting post 32 grasps the first end 36 of the left orientating rod 10. Mounting post 34 grasps the first end 38 of right orientating rod 12. The first ends 36 and 38 respectively of the left and right orientating rods 10 and 12 are parallel to the top surface 14 of the pin wheel guard. After proceeding over the edge 40 of the top surface 14 of the pin wheel guard 16, the orientating rods 10 and 12 descend at a right angle downwardly parallel to a back edge 42 of the pin guard 16. The portion 43 of rod 10 parallel to side 42 is approximately half the length of first end 36. Thereafter, rod portion 45 descends away from the pin wheel 18 and terminates at rod second end 47. The portion 44 of rod 12 projects downwardly parallel to wall 42 of the pin guard and then terminates at rod second end 46. Thus rod 10 has four different directional portions and rod 12 has three different directional portions.

The mounting posts 32 and 34, respectively, are held in place by a nut 52 attached at the bottom of a threaded end of the mounting post 32 at a lower surface of the pin wheel guard 16. Release of nut 52 permits turning of mounting posts 32 or 34. The hex head bolt 50 can be loosened to permit the mounting post to adjust its grip on the first end 36 or 38 of orientating rods 10 or 12, respectively. This allows adjustment of either rod 10 or 12 to provide proper alignment of the pins 20 as they are presented to the orientating rods.

The holes drilled in the top surface 14 of the pin wheel guard 16 to accommodate the threaded end of post 32 or 34 should be approximately three quarters of an inch from the front edge 40 of the guard 16. These holes should be directly behind the turnaround pan rods 54 with the distributor pointed at the number one pin in the pin setting apparatus. One should start first with rod 10 or 12 lined up with the distributor rod 54 and a side edge 27 of the turnaround pan 22. The portion 43 44 of the rods should be approximately three quarters of an inch from the front portion of the pin wheel 18. The positions given are starting positions and must be adjusted according to the drop off point from the pin wheel of the pins and the nature of other equipment in use.

Automatic pin setters are usually designed so that pin wheels on adjacent machines move towards each other. FIG. 1 shows a typical rear view arrangement in which motor 60 drives pin wheel 18*a* in a counter clock wise direction. Looking from the front of the pin wheel 18*a*, rod 10 is located on the right side of the top portion of pin wheel guard 16. Motor 62 drives pin wheel 18*b* in a clock wise direction. In this arrangement, looking from the front of pin wheel 18*b*, rod 10 is located on the left side of the top portion of the pin wheel guard 16. Another means of describing the configuration is that rod 10 will always be mounted closest to the pin wheel drive motor.

The operation of rods 10 and 12 will consistently cause the pins 20 to fall base 26 first down on to the turnaround pan 22 and then move in the same position along the distributor belt 30 to the automatic pin setters. In this manner, the method of this invention prevents pileups from the pin wheel since the base of each pin is consistently presented to the distributor belt. The side guards 56 on the distributor prevent any rolling off of the pins as they move down the distributor belt 30. Flywheel 58 positions the distributor to deposit pins in the proper location in the pin setting apparatus.

Slight modifications from the invention may be made in the curvature of rods 10 and 12 without departing from the invention set forth above.

Having thus described the invention, what is claimed and desired to be secured by Letters patent is:

1. In a method for orientating bowling pins deposited from a top portion of a rotating pin wheel shielded by a pin wheel guard in an automatic pin setting machine, the improvement comprising mounting a pair of orientation rods on a top surface of the pin wheel guard, each rod having at least three different directional portions, a first end portion spaced apart and parallel to the top surface of the pin wheel guard, a downwardly descending middle portion spaced apart and parallel to a back surface of the pin wheel guard and a downwardly descending second end portion, each rod spaced apart and above a side edge of a turnaround pan, located below a top exit from the pin wheel, the rods contacting the head of a bowling pin falling from the pin wheel to the turnaround pan, the rods orientating the bowling pin as it contacts the turnaround pan and the pins then moving outwardly on a distributor belt attached to the turnaround pan in a direction away from the pin wheel in a base first configuration.

2. The method according to claim 1 wherein one rod has three integral directional portions and the other has four integral directional portions, the four directional portion rod being mounted closest to a drive motor for driving the pin wheel.

3. The method according to claim 1 wherein the first end of each rod is separately mounted by a mounting post bolted to the pin wheel guard.

4. The method according to claim 1 wherein the second end of each rod is spaced apart and over the turnaround pan.

5. A method for orientating bowling pins deposited from a top portion of a rotating pin wheel shielded by a pin wheel guard in an automatic pin setting machine comprising, (a) mounting a pair of adjustable orientating rods on a top surface of the pin wheel guard at each side of an exit from the pin wheel and above an edge of a turnaround pan receiving pins from the pin wheel exit, (b) an end portion of one orientating rod distal from the pin wheel guard contacting the pin at a top end as it exits from the pin wheel and turning the pin so that a base end of the pin is presented to a distributor belt attached to the turnaround pan, and (c) the distributor belt feeding the pin to a pin setter apparatus in a base end down configuration.

6. The method according to claim 5 wherein each rod is held at a first end portion parallel to a top surface of the pin wheel shield within a through channel of a mounting post attached to a top surface of the pin wheel shield and the post is bolted by a nut to a bottom surface of the shield.

7. The method according to claim 6 wherein a hex nut is screwed into a top surface of the mounting post and contacts the rod first end to hold it in position within the mounting post channel and releases the rod for adjustment in position by being partially unscrewed from the mounting post.

8. The method according to claim 5 wherein the rod is mounted at a proximate end portion to the pin wheel guard and a second portion is at a right angle to the proximate end and is adjacent an end portion distal from the pin wheel guard.

9. The method according to claim 5 wherein the adjustable orientating rods are moved in three dimensions to accommodate a pin exiting from the pin wheel.

10. In an automatic bowling pin setting machine a pair of adjustable orientating rods mounted on a top surface of a pin wheel guard at each side of an exit from a pin wheel shielded by the guard, the rods being above an edge of a turnaround pan receiving pins from the pin wheel exit, each rod extending downwardly from the pin wheel guard to contact the head of a bowling pin exiting from the pin wheel and causing the bowling pin to orient base end down when leaving the turnaround pan to move along a distributor belt attached to the turnaround pan at an end distal from the pin wheel.

* * * * *